US009895887B2

(12) United States Patent
Ishikura et al.

(10) Patent No.: US 9,895,887 B2
(45) Date of Patent: Feb. 20, 2018

(54) LIQUID EJECTION HEAD AND PROCESS FOR PRODUCING THE SAME

(71) Applicant: CANON KABUSHIKI KAISHA, Tokyo (JP)

(72) Inventors: Junri Ishikura, Tokyo (JP); Yo Watanabe, Yokohama (JP); Norihiko Ochi, Kawasaki (JP); Hidehiko Fujimura, Hachioji (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/897,925

(22) PCT Filed: Jun. 23, 2014

(86) PCT No.: PCT/JP2014/067292
§ 371 (c)(1),
(2) Date: Dec. 11, 2015

(87) PCT Pub. No.: WO2015/005154
PCT Pub. Date: Jan. 15, 2015

(65) Prior Publication Data

US 2016/0136952 A1 May 19, 2016

(30) Foreign Application Priority Data

Jul. 9, 2013 (JP) ..... 2013-143540

(51) Int. Cl.
*B41J 2/14* (2006.01)
*B41J 2/16* (2006.01)

(52) U.S. Cl.
CPC ..... *B41J 2/1433* (2013.01); *B41J 2/14209* (2013.01); *B41J 2/162* (2013.01);
(Continued)

(58) Field of Classification Search
CPC ..... B41J 2/1433; B41J 2/14209; B41J 2/162; B41J 2/1629; B41J 2/1643; B41J 2002/14475; B41J 2002/11
See application file for complete search history.

(56) References Cited

U.S. PATENT DOCUMENTS 5,432,540 A 7/1995 Hiraishi
5,605,659 A * 2/1997 Moynihan ..... B41J 2/14201 156/89.12
(Continued)

FOREIGN PATENT DOCUMENTS

CN 1475351 A 2/2004
CN 1935515 A 3/2007
(Continued)

OTHER PUBLICATIONS

Shinichi Nishi et al., "Development of an Energy Efficient Shear-Type Inkjet Head," 93rd Annual Conference of the Imaging Society of Japan, pp. 1-4 (Jun. 3, 2004).
(Continued)

*Primary Examiner* — Sharon A Polk
(74) *Attorney, Agent, or Firm* — Fitzpatrick, Cella, Harper & Scinto

(57) ABSTRACT

Provided is a liquid ejection head capable of stably ejecting a liquid at a practical liquid droplet velocity without separating minute liquid droplets before ejection of main liquid droplets in the case of reducing the amount of liquid droplets by reducing a nozzle diameter of the liquid ejection head. In a liquid ejection head including a nozzle for ejecting a liquid, a recess portion recessed relative to a nozzle inner wall surface is formed on a nozzle inner wall in a region having a nozzle inner diameter of 15 μm or less.

2 Claims, 7 Drawing Sheets

(52) U.S. Cl.
CPC ..... *B41J 2/1629* (2013.01); *B41J 2/1643* (2013.01); *B41J 2002/14475* (2013.01); *B41J 2202/11* (2013.01)

(56) References Cited

U.S. PATENT DOCUMENTS

| | | | | |
|---|---|---|---|---|
| 6,290,331 | B1 | 9/2001 | Agarwal et al. | |
| 6,851,778 | B2 | 2/2005 | Okuda | |
| 7,549,716 | B2 | 6/2009 | Kida et al. | |
| 7,874,657 | B2 | 1/2011 | Nagashima | |
| 9,193,163 | B2 | 11/2015 | Ochi et al. | |
| 9,365,037 | B2 | 6/2016 | Fukaya et al. | |
| 2003/0103108 | A1 | 6/2003 | Liu et al. | |
| 2006/0176338 | A1 | 8/2006 | Deguchi et al. | |
| 2007/0058010 | A1 | 3/2007 | Nagashima et al. | |
| 2007/0146399 | A1* | 6/2007 | Yamamoto ..... | B41J 2/04581 347/9 |
| 2007/0200896 | A1 | 8/2007 | Ozawa et al. | |
| 2007/0216726 | A1 | 9/2007 | Shimura et al. | |
| 2010/0134560 | A1 | 6/2010 | Doi et al. | |
| 2013/0021411 | A1 | 1/2013 | Feinn et al. | |
| 2013/0187984 | A1 | 7/2013 | Feinn et al. | |

FOREIGN PATENT DOCUMENTS

| | | | | |
|---|---|---|---|---|
| CN | 102905902 | A | | 1/2013 |
| EP | 1 024 008 | A2 | | 8/2000 |
| JP | 5-155028 | A | | 6/1993 |
| JP | H05155028 | | * | 6/1993 |
| JP | 5-318730 | A | | 12/1993 |
| JP | 2003-165220 | A | | 6/2003 |
| JP | 2004-009677 | | | 1/2004 |
| JP | 2007-38654 | A | | 2/2007 |
| JP | 2008-62395 | A | | 3/2008 |
| JP | 2008-87365 | A | | 4/2008 |
| WO | 2004/056573 | A1 | | 7/2004 |
| WO | 2011/123120 | A1 | | 10/2011 |

OTHER PUBLICATIONS

First Office Action in Chinese Application No. 201480038839.2 (dated Jun. 2, 2016).
Second Office Action in Chinese Application No. 201480038839.2 (dated Feb. 4, 2017).
Extended European Search Report in European Application No. 14823678.9 (dated Jul. 14, 2017).

* cited by examiner

LIQUID EJECTION HEAD AND PROCESS FOR PRODUCING THE SAME

TECHNICAL FIELD

The present invention relates to a liquid ejection head including a nozzle for ejecting a liquid, and a process for producing the liquid ejection head.

BACKGROUND ART

An ink jet head, which is a liquid ejection head, is configured to inject liquid droplets by changing an ink pressure in a pressure chamber to cause ink to flow so that the ink is ejected from an ejection orifice. In particular, a drop-on-demand type head has been most widely used. Further, a system for applying a pressure to ink is roughly classified into two systems. One system involves changing a pressure of ink by changing a pressure in a pressure chamber with a driving signal to a piezoelectric element, and the other system involves applying a pressure to ink by generating air bubbles in a pressure chamber with a driving signal to a resistor.

An ink jet head using a piezoelectric element can be relatively easily produced by machining a bulk piezoelectric material. Further, the ink jet head using a piezoelectric element has another advantage in that there is relatively little restriction on ink, and a wide range of ink materials can be applied selectively onto a recording medium. From the foregoing point of view, in recent years, there is an increasing attempt to use an ink jet head for industrial purposes such as the production of a color filter and the formation of wiring.

In a piezoelectric ink jet head for industrial use, a shear mode system has often been adopted. The shear mode system involves applying an electric field to a polarized piezoelectric material in an orthogonal direction to subject the piezoelectric material to shearing deformation. A piezoelectric portion to be deformed is a partition wall portion formed by processing a polarized bulk piezoelectric material with a dicing blade so as to form an ink groove or the like. Electrodes for driving a piezoelectric element are formed on both sides of the partition wall, and a nozzle plate having a nozzle formed therein and an ink supply system are formed, with the result that an ink jet head is formed.

As a shear mode type ink jet head, there is an ink jet head formed of an ink groove containing ink and an air groove not containing ink adjacent to the ink groove, as described in Patent Literature 1. A partition wall between the ink groove and the air groove is deformed by grounding the electrode on the ink groove side and applying a signal voltage to the electrode on the air groove side. The ink groove, which is in contact with ink, is grounded in this system, and hence ink having high conductivity can be used (see Patent Literature 1).

In recent years, there is a demand for high definition patterning in a liquid ejection device. Therefore, it is necessary that ejection liquid droplets be miniaturized. The amount of liquid droplets to be required is about sub pL to several pL. In general, the size of a liquid droplet is about the size of a nozzle diameter. Then, in order to form a liquid droplet smaller than a nozzle diameter, there has been considered a method using meniscus driving of controlling meniscus at high speed. For example, Patent Literature 2 describes a method of controlling meniscus so as to form a liquid droplet of 1 pL or less with respect to a nozzle diameter of φ20 μm or less. Specifically, Patent Literature 2 defines a voltage change amount and a voltage change time in a voltage change process so as to control a drawn-in amount of meniscus.

As described in Non Patent Literature 1 regarding parameters of an ejection amount and a liquid ejection head in a shear mode type liquid ejection device, according to the simplest driving (push-ejection) method for ejection using the resonance of a liquid chamber, the ejection amount becomes as follows: Ejection amount=π×(nozzle diameter)^2×(liquid droplet velocity)/2/Fr (resonance frequency of a liquid chamber). Further, when a driving (pull-ejection) method for miniaturizing a liquid droplet is performed, the ejection amount becomes as follows: Ejection amount=π×(nozzle diameter)^2×(liquid droplet velocity)/4/Fr (resonance frequency of a liquid chamber). Thus, the amount of liquid droplets can be reduced to about a half. Further, the ejection amount can be reduced to about 30% by controlling the application of a pulse in the above-mentioned driving waveform. Thus, the ejection amount can be reduced to about several pL and controlled stably to some degree by the driving method.

However, it is very difficult to stably eject liquid droplets of about sub pL to 2 pL with a nozzle diameter of about φ20 μm by a driving method in a liquid ejection device using piezoelectric driving. For example, as described in Patent Literature 3, when the velocity of main liquid droplets is set to a certain velocity or more, minute liquid droplets are separated at high speed before ejection of the main liquid droplets, depending on a driving waveform, and thus it is difficult to control the ejection amount.

CITATION LIST

Patent Literature

PTL 1: Japanese Patent Application Laid-Open No. H05-318730

PTL 2: Japanese Patent Application Laid-Open No. 2003-165220

PTL 3: Japanese Patent Application Laid-Open No. 2007-38654

Non Patent Literature

NPL 1: "Development of Energy Efficient Shear-Type Inkjet Head" KONICA MINOLTA TECHNOLOGY CENTER, INC., S. NISHI, et al., The Annual Conference of the Imaging Society of Japan, (93th) Jun. 3, 2004

SUMMARY OF INVENTION

Technical Problem

As described above, in the case where a nozzle diameter is set to φ15 μm or less in a shear mode type liquid ejection device, when a liquid droplet velocity is set to a certain velocity or more, minute liquid droplets are separated at high speed before ejection of main liquid droplets. Thus, minute liquid droplets are formed before main liquid droplets are formed, and further in the case of high speed, the minute liquid droplets adhere onto an image forming substrate before the main liquid droplets land on the substrate. The main liquid droplets land on the substrate after the minute liquid droplets adhere onto the substrate, and hence there arises a problem in that drawing dots are distorted. Alternatively, the liquid droplets separated before ejection of the main liquid droplets are very small, and hence there is a high possibility that the minute liquid droplets may be greatly decelerated due to the air resistance and float due to the influence by disturbance before landing on the substrate. Thus, there is a problem in that, when minute liquid droplets are formed before main liquid droplets are formed, an image with high definition may not be formed.

The above-mentioned phenomenon occurs as follows. When the nozzle diameter is very small, for example, φ15 μm or less, the distance between a nozzle wall surface and a nozzle center is small. Therefore, the influence of viscosity resistance becomes greater, and the flow velocity in a center portion becomes higher. When the flow velocity in the nozzle center portion becomes too high with respect to the flow velocity in the nozzle wall surface portion, only a part of the center portion is separated at timing earlier than the timing at which main liquid droplets are formed.

Further, the liquid droplet separation in the center portion does not occur in the case where the velocity of liquid droplets is low, but occurs when the liquid droplet velocity is increased.

On the other hand, in order to obtain a normal pattern, a liquid droplet velocity of about 5 m/s or more is required.

Accordingly, it is important to suppress the separation of liquid droplets in the center portion by reducing the difference between the flow velocity in the nozzle wall surface portion and the flow velocity in the nozzle center portion in a practical velocity region in which a normal pattern is obtained. That is, it is necessary to increase a velocity threshold at which the liquid droplet separation occurs to a practical velocity region or more.

It is an object of the present invention to provide a liquid ejection head including a nozzle for ejecting a liquid, which is capable of ensuring a liquid droplet velocity of about 5 m/s and further stably ejecting liquid droplets without separating minute liquid droplets before ejection of main liquid droplets by reducing the difference between the flow velocity in a nozzle wall surface portion and the flow velocity in a nozzle center portion in the case where the nozzle diameter is as small as φ5 μm to φ15 μm.

Solution to Problem

According to one embodiment of the present invention, there is provided a liquid ejection head including a nozzle for ejecting a liquid, wherein a recess portion recessed relative to a nozzle inner wall surface of the nozzle is formed on a nozzle inner wall in a region having an inner diameter of the nozzle of 15 μm or less.

Advantageous Effects of Invention

According to one embodiment of the present invention, in the liquid ejection head including the nozzle for ejecting a liquid, an ejection velocity at a practical level is ensured and further the ejection of minute liquid droplets can be controlled stably without separating the minute liquid droplets before ejection of main liquid droplets.

Further features of the present invention will become apparent from the following description of exemplary embodiments with reference to the attached drawings.

BRIEF DESCRIPTION OF DRAWINGS

FIG. 7C is a schematic view of a nozzle hole mold for producing the nozzle of FIG. 7B by electroforming or the like.

DESCRIPTION OF EMBODIMENTS

Embodiments for carrying out the present invention are hereinafter described in detail with reference to the drawings.

Figure 1:
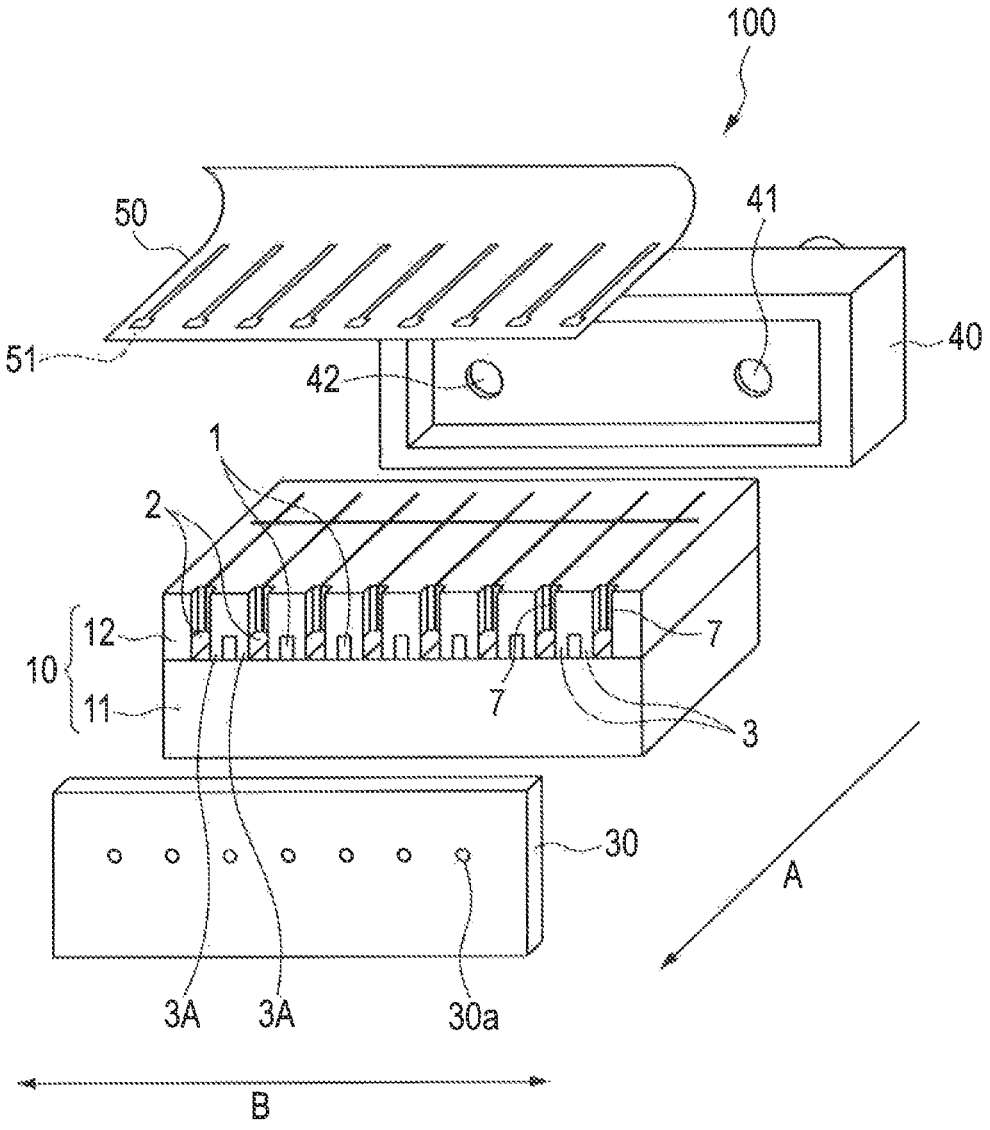
FIG. 1 is a schematic view of an ink jet head according to an embodiment of the present invention.

FIG. 1 is a schematic exploded view illustrating an ink jet head as an example of a liquid ejection head according to an embodiment of the present invention. An ink jet head 100 illustrated in FIG. 1 includes an ejection unit 10 having multiple pressure chambers 1 and multiple dummy chambers 2 arranged in a row in a width direction B orthogonal to a liquid ejection direction A. A nozzle plate 30, which has multiple ejection orifices 30*a* formed so as to correspond to the respective pressure chambers 1 serving as nozzles for ejecting a liquid, is arranged on a surface (front surface) of the ejection unit 10 on a liquid ejection side. The ejection unit 10 and the nozzle plate 30 are bonded and aligned to each other so that the positions of the pressure chambers 1 are matched with those of the ejection orifices 30*a* (that is, the pressure chambers 1 communicate with the ejection orifices 30*a*). The pressure chambers 1 pass through from the front surface to a liquid supply surface (back surface), and the dummy chambers 2 pass through the front surface side but do not pass through the liquid supply surface (back surface) side.

A manifold 40 provided with an ink supply port 41 and an ink recovery port 42, which communicate with an ink tank (not shown), is joined to the back surface side of the ejection unit 10. Further, multiple front grooves 7 communicating with the respective dummy chambers 2 are formed on the front surface side of the ejection unit 10. A flexible substrate 50 is joined to an upper surface of the ejection unit 10.

Figure 2:
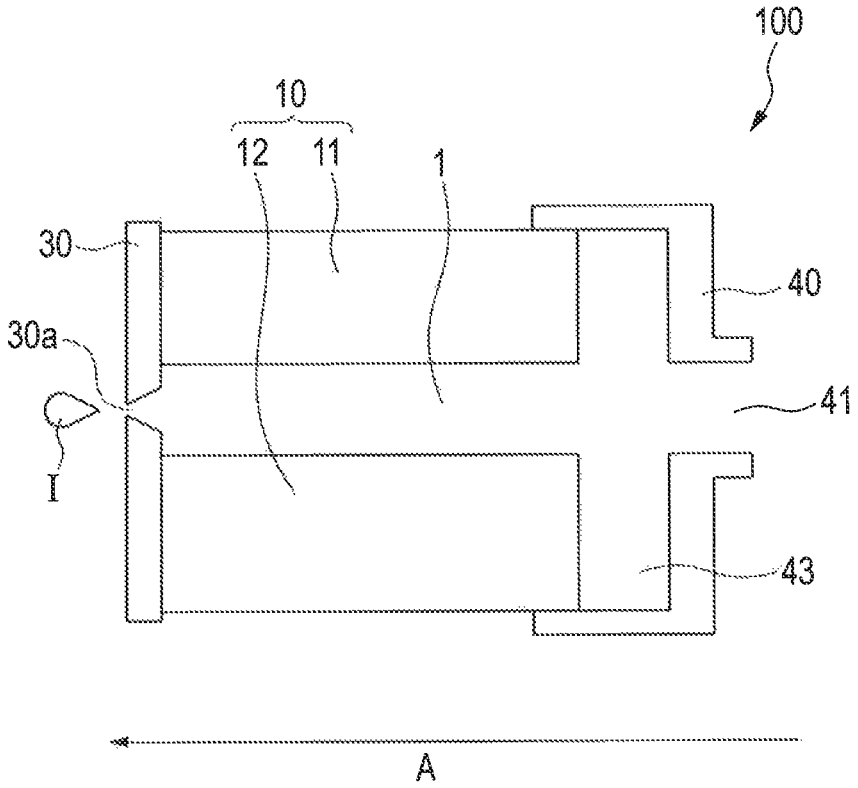
FIG. 2 is a schematic view of the ink jet head according to the embodiment of the present invention.

FIG. 2 is a schematic view of a cross-section of an ink flow path illustrating a flow of ink in the ink jet head 100. Ink I supplied from the ink tank (not shown) fills each pressure chamber 1 through the ink supply port 41 and a common liquid chamber 43 in the manifold 40 and is appropriately ejected from each ejection orifice 30*a*.

As illustrated in FIG. 1, each pressure chamber 1 of the ejection unit 10 is formed so as to be partitioned by two partition walls 3 adjacent to each other, which are formed of a polarized piezoelectric material. Each partition wall 3 extends from the front surface to which the nozzle plate 30 is mounted to the back surface of the common liquid chamber 43.

Each partition wall 3 is provided with electrodes (described later) on both side surfaces. The partition wall 3 is subjected to shearing deformation to change the volume of the pressure chamber 1 by applying a voltage between the electrodes in a direction orthogonal to a polarization direction, with the result that the ink I which is a liquid is ejected from the ejection orifice 30*a*.

The nozzle serving as the ejection orifice 30*a* has a shape, for example, as illustrated in FIGS. 3B to 9B, and ink flows into the nozzle from an entering side thereof and is ejected from an exiting side thereof to fly as a liquid droplet.

The nozzle plate having a nozzle is formed of a metal, a resin, a ceramics, or the like, considering the kind of ink to be used, durability, processing accuracy, and the like. Examples of a method of forming a nozzle hole include laser processing, pressing using a punch, and a formation method involving forming a mold serving as an original shape of a nozzle hole followed by electroforming and further mold etching.

As the shape of a recess portion recessed relative to a nozzle inner wall surface provided on an inner wall of a nozzle of the liquid ejection head of the present invention, a hollow shape and a groove shape may be mentioned. The shape of the recess portion is not limited thereto as long as the effects of the present invention are obtained.

Regarding the processing of the recess portion recessed relative to a nozzle inner wall surface in a hollow shape or a groove shape on a nozzle inner wall of the present invention, the recess portion may be provided after a nozzle hole to be a basis is formed in advance, or the recess portion may be provided simultaneously with the formation of a nozzle hole.

For example, may be mentioned the following: a method involving forming a nozzle plate with a material made of multiple substances, further forming nozzle holes, and etching only a specified substance through use of the difference in etching selectivity of the substances forming the material, thereby forming a hollow shape or a groove shape; a method involving fixedly arranging a material which reacts with a nozzle material in a solution to elute the nozzle material or a material containing ions of the material to a nozzle inner wall by coating, drying, and the like, and reacting the material fixed to the nozzle inner wall with the nozzle material in the solution to obtain a hollow shape or a groove shape; and a method involving providing a projection shape on a mold itself serving as an original shape of a nozzle hole, and subjecting the mold to electroforming, grinding and polishing, and mold etching to obtain a hollow shape or a groove shape.

Figure 3A:
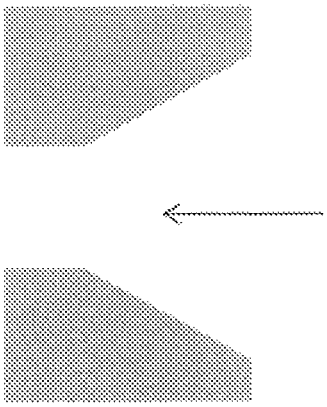
FIG. 3A is a schematic view of a nozzle cross-section having a straight tapered portion from an entering side to an exiting side and a straight portion with the same diameter as an exiting diameter.
Figure 4A:
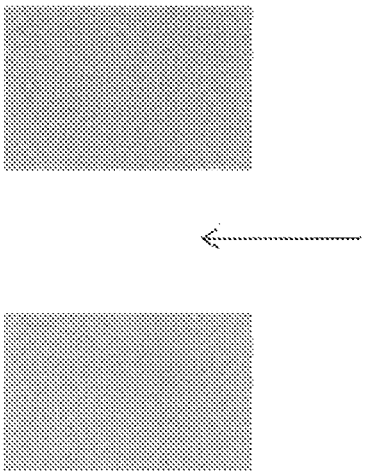
FIG. 4A is a schematic view of a nozzle cross-section having a constant inner diameter from an entering side to an exiting side.
Figure 4B:
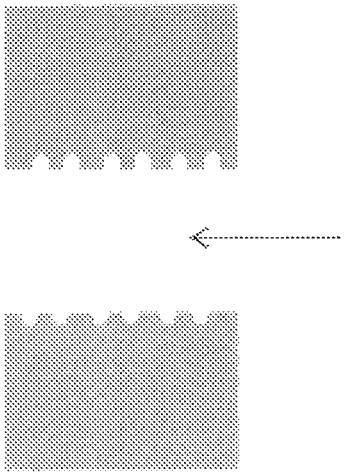
FIG. 4B is a schematic view of a nozzle cross-section having a hollow recess on an inner wall of the nozzle of FIG. 4A.
Figure 5A:
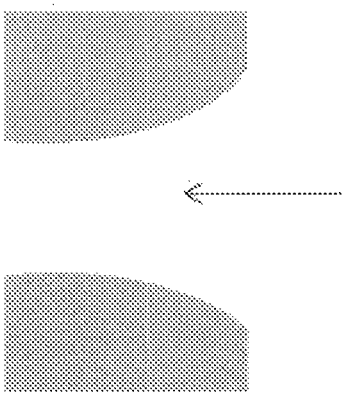
FIG. 5A is a schematic view of a nozzle cross-section having a curved shape from an entering side to an exiting side.
Figure 6A:
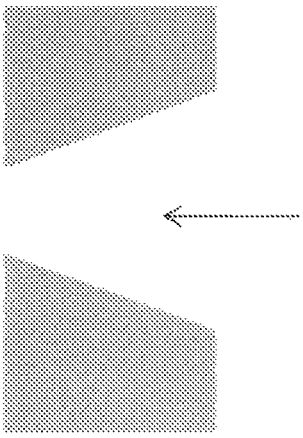
FIG. 6A is a schematic view of a nozzle cross-section having a straight tapered portion from an entering side to an exiting side.
Figure 6B:
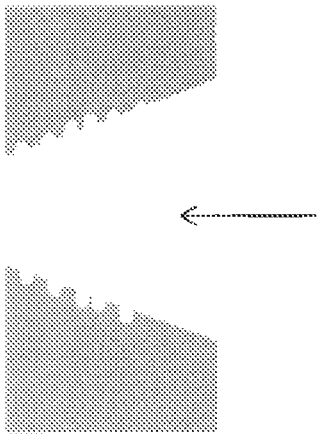
FIG. 6B is a schematic view of a nozzle cross-section having a hollow recess on an inner wall of the nozzle of FIG. 6A.

Further, as the shape serving as a base of a nozzle without a hollow shape or a groove shape, the following shapes are listed: a shape which is wider on an entering side relative to an exiting side and which is straight on the exiting side as illustrated in FIG. 3A; a shape having a constant diameter from an entering side to an exiting side as illustrated in FIG. 4A; a shape having a smooth taper from an entering side to an exiting side as illustrated in FIG. 5A; and a shape having a straight taper from an entering side to an exiting side as illustrated in FIG. 6A. However, the present invention is not limited to those illustrated in the drawings.

The recess portion in a hollow shape or a groove shape is provided on a nozzle inner wall preferably in a region having a nozzle inner diameter of 15 μm or less, more preferably in a region extending from a portion having a nozzle minimum inner diameter to a portion having a nozzle inner diameter twice the minimum inner diameter. Great effects are obtained by providing the recess portion in that region. As a method of forming a hollow shape or a groove shape in that region, a process of forming a shape for transferring the hollow shape or the groove shape on a mold itself serving as an original shape of a nozzle hole, followed by electroforming, grinding and polishing, and mold etching, is easily performed.

When the size of the recess portion in a hollow shape or a groove shape is too small, effects are insufficient. In the case where the recess portion has a hollow shape, it is preferred that the maximum area of a recess opening portion be 0.8 $\mu m^2$ or more and 20 $\mu m^2$ or less. In the case where the recess portion has a groove shape, it is preferred that the width be 1 μm or more and 6 μm or less and the depth be 0.5 μm or more and 3 μm or less.

As for the size control of the hollow shape, a method involving forming a basic shape of a nozzle hole in advance, fixedly arranging a material which reacts with a nozzle material in a solution to elute the nozzle material or a material containing ions of the material to the basic shape by coating, drying, and the like, and controlling the size of the hollow shape by reaction time or the like is relatively easily performed. Alternatively, with a method involving forming a nozzle with a material made of multiple substances and selectively etching only a specified substance, the size-controlled recess portion can also be relatively easily formed by controlling a mixed ratio of the substances in the original material.

The size control of a groove shape can be easily performed by a process of forming a projection shape controlled in advance on a mold itself serving as an original shape of a nozzle hole, followed by electroforming, grinding and polishing, and mold etching.

As described above, by processing a nozzle hole and then forming a film having a water-repellent function on an ejection orifice side of a nozzle plate by vacuum deposition or the like, the directivity of liquid droplets after ejection is stabilized.

Next, the nozzle plate is bonded to an ejection unit, and a flexible cable for feeding power, a manifold for supplying ink, and the like are mounted on the resultant to obtain an ink jet head.

Next, more specific examples are described.

Example 1

First, an ejection unit 10 (FIG. 1) was formed as follows. A piezoelectric body formed of lead zirconate titanate (PZT) ($PbTiZrO_3$) was polarized, and a plate thickness thereof was adjusted by polishing. Then, non-polarized sides of the resultant piezoelectric bodies were bonded and cured with an epoxy-based adhesive, and individual liquid chambers 1 were formed by dicing (FIG. 1).

Next, similarly, dummy chambers 2 were formed by dicing as illustrated in FIG. 1.

Then, extraction electrode grooves 7 (FIG. 1) were formed on an air groove side by dicing.

Note that, electrodes for applying a voltage were formed by electroless plating. A plated film was removed by polishing from surfaces not requiring a plated film, such as the surface to which a nozzle plate was to be bonded and an upper portion of a partition wall.

Next, in order to drive an individual partition wall with respect to one individual liquid chamber, a dividing groove for dividing an electrode was formed by dicing in a bottom portion of the dummy chamber.

Further, in addition to the processing of the electrode dividing groove, a clearance groove for an adhesive was fabricated through use of the same blade as that used for forming the dividing groove on a lower side of an opening of the individual liquid chamber on the front surface so as to cross the extractor electrode grooves.

Next, a method of fabricating a nozzle plate is described.

Figure 3B:
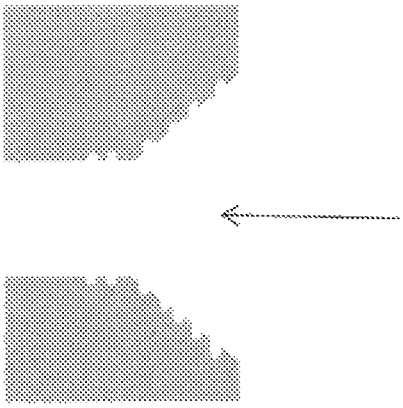
FIG. 3B is a schematic view of a nozzle cross-section having a hollow recess on an inner wall of the nozzle of FIG. 3A.

In this example, a nozzle having a shape as illustrated in FIG. 3B was produced, the nozzle having a plate thickness of 80 μm, an ink entering side diameter of φ50 μm and an exiting side diameter of φ3 μm, φ5 μm, φ10 μm, φ15 μm, φ20 μm, and φ30 μm as a nozzle hole size, and a straight length of 5 μm. A metal member containing Cu was first processed with an endmill to produce a projection shape portion serving as a mold of a nozzle hole in one Cu block, the projection shape portion having a tip end of φ3 μm, φ5 μm, φ10 μm, φ15 μm, φ20 μm, and φ30 μm, a straight portion of about 10 μm, and a bottom portion of φ50 μm. That is, a member formed of a metal containing Cu having a projection shape portion was prepared. Next, a metal containing Ni—P or a metal containing Ni—B was caused to adhere onto the member by plating to cover the projection shape portion. That is, the member was subjected to Ni—P plating or Ni—B plating. After that, the plated film was removed so as to become substantially flat by a cutting process, and finally the resultant was ground together with the straight portion at the tip end of the Cu mold until the plate thickness reached 80 μm.

Next, the projection shape portion of the Cu mold and an etchant (for example, an alkaline solvent) were brought into contact with each other to remove the projection shape portion by etching, with the result that the metal containing Ni—P or the metal containing Ni—B covering the projection shape portion was exposed to form a hole portion. That is, a nozzle plate serving as a base was produced (FIG. 3A). After that, the nozzle plate was dried while the etchant remaining in a nozzle (hole portion) to leave a Cu residue in the etchant to adhere onto the inside of the nozzle (hole portion). Next, the hole portion (nozzle plate) was soaked in a solution containing sulfuric acid (for example, a sulfuric acid solution containing 1% by weight of sulfuric acid) for 24 hours to react the Cu residue in the etchant remaining in the nozzle (hole portion) with Ni of the plating, to thereby produce a recess (recess portion) in a hollow shape on an Ni surface.

Finally, the resultant was washed with pure water to complete a nozzle plate.

The area of an opening of the hollow shape (recess portion) in the nozzle (hole portion) thus obtained is about 1 $\mu m^2$ to 10 $\mu m^2$ at a central value.

Further, for comparison, a nozzle without a hollow shape (recess portion) in a nozzle (hole portion) was also produced as a head similarly.

Next, a fluorine-based water-repellent film was formed on the nozzle plate from an exiting side by vacuum deposition.

Then, the nozzle plate and the ejection unit were bonded to each other, and a flexible cable for feeding power, a manifold for supplying ink, and the like were mounted on the resultant to complete an ink jet head.

Next, an ink ejection state was evaluated through use of a mixed solution containing 85% ethylene glycol and 15% water as ink for the liquid ejection head. Ink was introduced from a supply port of a manifold via a Tygon tube.

As a driving condition for ejection, a rectangular wave of 17 V with a pulse width of 8 μs was applied. The ejection frequency was set to 5,000 Hz. The evaluation was conducted by microscope observation through use of a nanopulse light source, and the flying state and liquid droplet velocity of liquid droplets were evaluated.

Table 1 shows the ejection state and liquid droplet velocity depending on the presence/absence of a hollow shape (recess portion) in a nozzle (hole portion).

With a nozzle having no hollow shape (recess portion), a phenomenon of the separation of liquid droplets occurred in the case of an exiting diameter of φ5 μm to φ15 μm. With a nozzle having an exiting diameter of φ3 μm, ejection itself did not occur. Further, normal ejection was performed in the case of an exiting diameter of φ20 μm or more.

On the other hand, with a nozzle having a hollow shape (recess portion), the separation of liquid droplets did not occur even in the case of an exiting diameter of φ5 μm to φ15 μm, and further, normal ejection was performed with an ejection amount of about 1.5 pL. In contrast, the liquid droplet velocity decreased in the case of an exiting diameter of φ20 μm or more.

From the foregoing, the following is considered. In the case where the nozzle exiting diameter is 15 μm or less, and the nozzle inner wall is smooth, the influence of wall surface resistance increases in a portion having a small exiting diameter, and thus the difference between the flow velocity on a wall surface side and the flow velocity in a nozzle center portion increases, and liquid droplets only in the center portion having a high flow velocity are separated after the ejection. On the other hand, in the case where a hollow shape is provided on a nozzle inner wall, the flow of ink changes from a laminar flow to a turbulent flow in a hollow portion, and a flow close to the center is mixed with a flow on a nozzle wall surface side to increase the flow velocity on the nozzle wall surface side. Consequently, the flow velocity difference between the center portion and the wall surface side is reduced, and the separation of liquid droplets can be suppressed.

Further, in the case where the exiting diameter is φ20 μm or more, the liquid droplet velocity rather decreases when a hollow shape is present. Therefore, a turbulent flow caused in a hollow portion becomes a resistance to decrease the velocity of the entire liquid droplets.

TABLE 1

| | Exiting diameter | | | | | |
|---|---|---|---|---|---|---|
| | Φ3 μm | Φ5 μm | Φ10 μm | Φ15 μm | Φ20 μm | Φ30 μm |
| No recess provided | No ejection | Separation of liquid droplet | Separation of liquid droplet | Separation of liquid droplet | 7 m/s | 9 m/s |
| Recess provided | No ejection | 5 m/s | 6 m/s | 9 m/s | 7 m/s | 8 m/s |

Example 2

An ejection unit was produced in the same way as in Example 1.

Figure 7A:
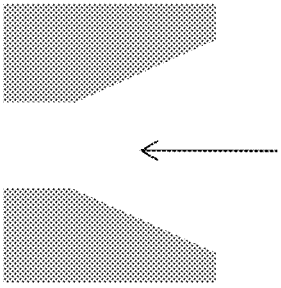
FIG. 7A is a schematic view of a nozzle cross-section having a straight tapered portion from an entering side to an exiting side and a straight portion with the same diameter as an exiting diameter.
Figure 7B:
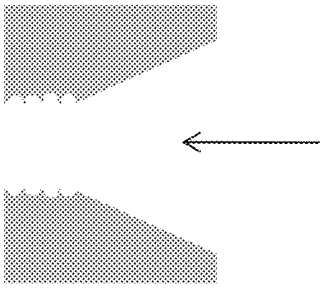
FIG. 7B is a schematic view of a nozzle cross-section having a groove shape on an inner wall of the straight portion of the nozzle of FIG. 7A.

A nozzle plate was provided with a groove shape in a straight region in which the diameter was minimum on an exiting side (FIG. 7B). The nozzle shape of this example had a nozzle plate thickness of 80 μm, a nozzle exiting side diameter of φ10 μm, a length of a straight region on an exiting side of 20 μm, and an entering side diameter of φ50 μm, the straight region having a groove shape with a width of 3.6 μm and a depth of 1.8 μm.

The production method therefor is described below.

First, a mold having a shape (projection shape portion) corresponding to a nozzle hole of a nozzle plate was produced by cutting Cu with an endmill in the same way as in Example 1.

Figure 7C:
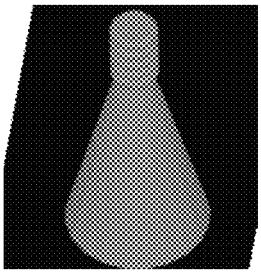

The mold had a bottom portion of φ50 μm and a tip end straight portion of φ10 μm having a length of 25 μm. Further, the tip end straight portion was provided with five ring-shaped projection portions each having a width of 3.6 μm and a projection height of 1.8 μm (FIG. 7C). Specifically, the above-mentioned projection shape portion and projection portions were formed by cutting a metal member containing Cu with an endmill, with the result that a member formed of a metal containing Cu having the projection shape portion on which the projection portions were formed was prepared. The position of the straight portion in which the member is formed is not to be cut by polishing in later steps. For comparison, a member having no ring-shaped projection portions was also produced simultaneously.

Next, in the same way as in Example 1, a metal containing Ni—P or a metal containing Ni—B was caused to adhere onto the projection shape portion by plating so as to cover the projection shape portion. That is, Ni—P plating or Ni—B plating was performed. Further, the plate thickness was adjusted to 80 μm by grinding and polishing, and the Cu mold was removed by etching. After that, a water-repellent film was vapor-deposited on an exiting surface side to complete a nozzle plate. That is, the member and an etchant (for example, an alkaline solvent) were brought into contact with each other to remove the projection shape portion by etching. The metal containing Ni—P or the metal containing Ni—B, covering the projection shape portion, was exposed by removing the projection shape portion, with the result that a hole portion having a groove shape formed thereon was formed.

FIG. 7A is a schematic view of a nozzle cross-section of a nozzle having no groove shape in a straight portion on an exiting side, and FIG. 7B is a schematic view of a nozzle cross-section of a nozzle having a groove shape in a straight portion on an exiting side.

Finally, the nozzle plate and the ejection unit were bonded to each other, and a flexible cable for feeding power, a manifold for supplying ink, and the like were mounted on the resultant to complete an ink jet head.

The ink jet head thus produced was evaluated for an ink ejection state through use of a mixed solution containing 85% ethylene glycol and 15% water as ink.

As the driving condition for ejection, a rectangular wave of 15 V to 18 V with a pulse width of 8 μs was applied. The ejection frequency was set to 5,000 Hz. In the same way as in Example 1, the evaluation was conducted by microscope observation through use of a nanopulse light source, and the flying state and liquid droplet velocity of liquid droplets were evaluated.

The results are shown in Table 2.

Although the velocity threshold at which the separation of liquid droplets occurs is 2.2 m/s in a nozzle having no grooves, the velocity threshold was able to be increased to at least 9 m/s by providing grooves. That is, the separation of liquid droplets was able to be suppressed at a practically required velocity of 5 m/s.

Further, the liquid droplet ejection amount was 1.5 pL or less in both cases.

The reason for the foregoing is considered as follows.

Even when a groove shape is provided in a portion having a small nozzle opening diameter on an exiting side, a flow becomes a turbulent flow in a groove portion in the same way as in the hollow shape, and the turbulent flow is mixed with a flow in a region close to a center portion having a high flow velocity, with the result that the flow velocity in a wall surface portion also becomes higher.

TABLE 2

| | 15 V | 16 V | 17 V | 18 V |
|---|---|---|---|---|
| No groove shape provided | 2 m/s | 2.2 m/s | Separation of liquid droplets | Separation of liquid droplets |
| Groove shape provided | 5 m/s | 6.5 m/s | 7.5 m/s | 9 m/s |

Example 3

An ejection unit was produced in the same way as in Examples 1 and 2.

Figure 5B:
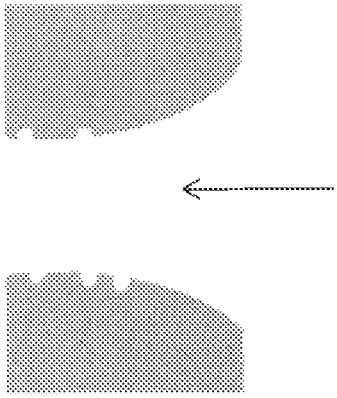
FIG. 5B is a schematic view of a nozzle cross-section having a hollow recess on an inner wall of the nozzle of FIG. 5A.

The nozzle plate had a shape having a smooth taper as illustrated in a schematic sectional view of FIG. 5A, and using an original shape having a plate thickness of 80 μm, a nozzle exiting side diameter of φ10 μm, and an entering side diameter of φ50 μm a nozzle was produced by varying a recess diameter of an inner wall (FIG. 5B). Wet etching is used for forming a recess in the same way as in Examples 1 and 2, which results in isotropic etching, and the depth of a recess is about ½ of a recess long diameter.

For producing a nozzle plate, a shape serving as a hole mold was first produced with an endmill. Then, the mold was subjected to Ni—P plating, followed by grinding and polishing to adjust the Ni—P plating to 80 μm. Finally, a Cu mold was removed with an alkaline etchant to obtain a nozzle plate. Regarding a nozzle plate having no hollow shape, washing with pure water and ultrasonic wave was performed after Cu etchant to complete a nozzle plate. Regarding a nozzle plate having a hollow shape, after the Cu mold was etched, the nozzle plate was dried while the etchant remained in a nozzle, and the size of the recess was adjusted by changing time for soaking the nozzle plate in diluted sulfuric acid while the Cu residue in the etchant was allowed to adhere onto a nozzle inner wall. When the nozzle plate is soaked in diluted sulfuric acid for a longer period of time, the reaction between Cu and Ni proceeds, and the size and depth of the recess increase. The nozzle plate with the recess size adjusted as described above was washed with pure water and ultrasonic wave and dried after the reaction was stopped.

Finally, a water-repellent film was formed from an exiting side of the nozzle plate, and the nozzle plate and the ejection unit were bonded to each other. Further, a flexible cable for feeding power, a manifold for supplying ink, and the like were mounted on the resultant to complete an ink jet head.

The ink jet head thus produced was evaluated for an ink ejection state through use of a mixed solution containing 92% ethylene glycol and 8% water as ink.

The method of evaluating the ejection state was the same as those of Examples 1 and 2, and the driving condition for ejection was the application of a rectangular wave of 13 V to 17 V with a pulse width of 8 μs. The ejection frequency was set to 5,000 Hz.

Table 3 shows a maximum value of a recess portion opening area of each nozzle and an ejection state and an ejection velocity at each voltage. The recess size was determined by obtaining the area of a recess portion opening by binarizing a hollow shape of a nozzle inner wall evaluated based on a scanning electron microscope (SEM) image by image analysis.

Thus, it is understood that a nozzle having a maximum area of a recess portion opening of less than 0.8 $\mu m^2$ behaves in the same way as a nozzle having no hollow shape, and when the velocity is increased by an increase in voltage, 2.5 m/s is found to be a velocity threshold of the separation of liquid droplets. Further, it is understood that, when the maximum area of a recess portion opening exceeds 0.8 $\mu m^2$, the velocity threshold of the separation of liquid droplets exceeds at least 2.5 m/s. Further, when the maximum area of a recess portion opening is about 20 $\mu m^2$ or more, the effects are almost saturated.

Further, even in a nozzle having a maximum area of a recess portion opening up to 20 $\mu m^2$, the ejected liquid droplet amount was 1.5 pL or less, but, in a nozzle having a maximum area of a recess portion opening of 40 $\mu m^2$, the liquid droplet amount of the nozzle was slightly larger, i.e., about 2 pL.

Accordingly, it can be said that the range of 0.8 $\mu m^2$ to 20 $\mu m^2$ of the maximum area of the recess portion opening has a great effect on the object of the present invention.

TABLE 3

| Maximum area of recess | 13 V | 14 V | 15 V | 16 V | 17 V |
|---|---|---|---|---|---|
| No recess provided | No ejection | 1.5 m/s | 2 m/s | 2.5 m/s | Separation of liquid droplets |
| 0.5 $\mu m^2$ | No ejection | 1.5 m/s | 2 m/s | 2.5 m/s | Separation of liquid droplets |

TABLE 3-continued

| Maximum area of recess | 13 V | 14 V | 15 V | 16 V | 17 V |
|---|---|---|---|---|---|
| 0.8 $\mu m^2$ | No ejection | 2 m/s | 2.8 m/s | 4 m/s | 5 m/s |
| 3.0 $\mu m^2$ | 1.5 m/s | 3 m/s | 4 m/s | 5 m/s | 6 m/s |
| 20 $\mu m^2$ | 1.8 m/s | 3.5 m/s | 4.2 m/s | 5.5 m/s | 6.5 m/s |
| 40 $\mu m^2$ | 1.8 m/s | 3.5 m/s | 4.2 m/s | 5.5 m/s | 6.5 m/s |

Example 4

The region in which a groove shape is formed on a nozzle plate inner wall was changed, and the relationship between the groove shape forming position and the ejection performance was checked.

An ejection unit was produced in the same way as in Examples 1 to 3.

Figure 8A:
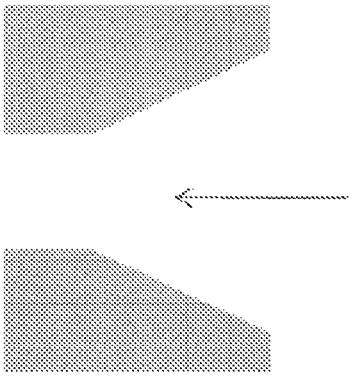
FIG. 8A is a schematic view of a nozzle cross-section having a straight tapered portion from an entering side to an exiting side and a straight portion with the same diameter as an exiting diameter.
Figure 8B:
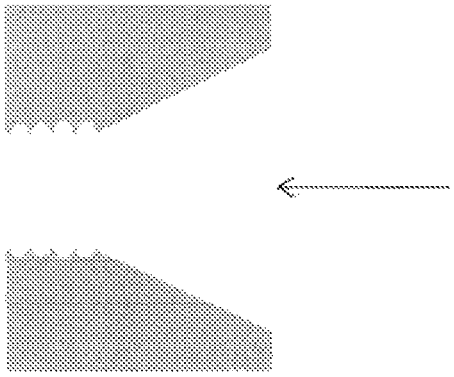
FIG. 8B is a schematic view of a nozzle cross-section having a groove shape on an inner wall of the straight portion of the nozzle of FIG. 8A.
Figure 8C:
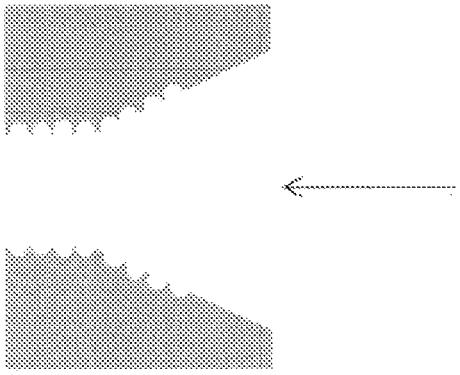
FIG. 8C is a schematic view of a nozzle cross-section having a groove shape on inner walls of the straight portion and the tapered portion extending from the straight portion to a portion having an inner diameter twice the exiting diameter of the nozzle of FIG. 8A.
Figure 8D:
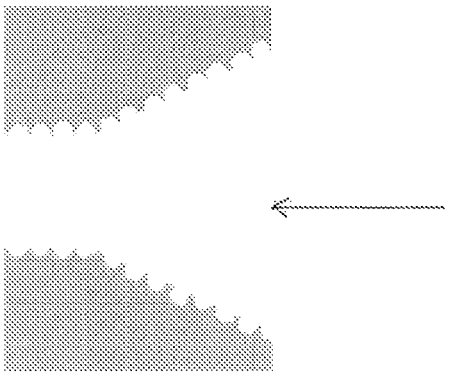
FIG. 8D is a schematic view of a nozzle cross-section having a groove shape on the entire inner wall of the nozzle of FIG. 8A.
Figure 9A:
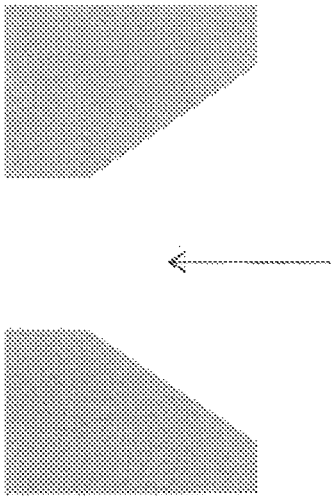
FIG. 9A is a schematic view of a nozzle cross-section having a straight tapered portion from an entering side to an exiting side and a straight portion with the same diameter as an exiting diameter.
Figure 9B:
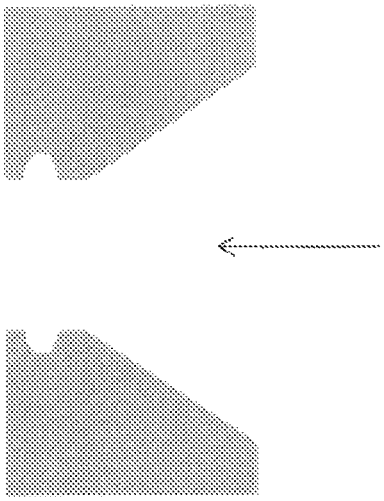
FIG. 9B is a schematic view of a nozzle cross-section having one groove shape on an inner wall of the straight portion of the nozzle of FIG. 9A.

The basic shape of a nozzle was set to have a nozzle plate thickness of 80 μm, a nozzle exiting side diameter of φ10 μm, an exiting side straight region of 20 μm, and an entering side diameter of φ40 μm. The nozzles produced with this basic shape are as follows: a nozzle having a ring-shaped groove with a width of 2 μm and a depth of 1 μm in a straight region (FIG. 8B); a nozzle having a ring-shaped groove with a width of 2 μm and a depth of 1 μm up to a portion having a diameter of φ20 μm which was twice that of an exiting diameter in a taper portion as well as in a straight region (FIG. 8C); and a nozzle having a ring-shaped groove with a width of 2 μm and a depth of 1 μm in the entire inner wall (FIG. 8D). For comparison, a nozzle having no ring-shaped groove (FIG. 8A) was also produced.

First, each mold corresponding to a nozzle hole having the above-mentioned ring-shaped groove was produced through use of Cu with an endmill.

Next, in the same way as in Examples 1 to 3, each mold was subjected to Ni—P plating, followed by grinding and polishing to adjust the plate thickness to 80 μm, and the Cu mold was removed by etching. After etching, the etchant was completely removed with a pure water and ultrasonic wave, followed by drying, and further a water-repellent film was vapor-deposited on an exiting surface side to complete a nozzle plate.

Finally, the nozzle plate and the ejection unit were bonded to each other, and a flexible cable for feeding power, a manifold for supplying ink, and the like were mounted on the resultant to complete an ink jet head.

The ink jet head thus produced was evaluated for an ink ejection state through use of a mixed solution containing 92% ethylene glycol and 8% water as ink.

The driving condition for ejection was the application of a rectangular wave of 15 V to 18 V with a pulse width of 8 μs. The ejection frequency was set to 5,000 Hz. In the same way as in Example 1, the evaluation was conducted by microscope observation through use of a nanopulse light source, and the flying state and liquid droplet velocity of liquid droplets were evaluated.

Table 4 shows ejection results of the nozzles produced as described above. In Table 4, (a) represents a reference nozzle having no groove shape (FIG. 8A), (b) represents a nozzle having a groove shape only in a straight portion having the same diameter as an exiting diameter (FIG. 8B), (c) represents a nozzle having a groove shape in a straight portion having the same diameter as an exiting diameter and in a tapered region having a diameter equal to or less than φ20

μm which is twice the exiting diameter (FIG. 8C), and (d) represents a nozzle having a groove shape in the entire nozzle inner wall (FIG. 8D).

It is understood from Table 4 that the nozzle having no groove shape represented by (a) has a velocity threshold of 2 m/s at which liquid droplets are separated, whereas the velocity threshold can be increased by providing a groove shape as represented by (b), (c), and (d), and the separation of liquid droplets can be suppressed at a practical liquid droplet velocity. In particular, it is understood that greater effects can be obtained by providing a groove shape only in a region having a small nozzle inner diameter on an exiting side as represented by (b) and (c). The reason for this is considered as follows. In a region having a small diameter, a turbulent flow is caused in a groove portion or a recess portion, and interexchange of flows occurs between the wall surface side and the region close to the center to increase a velocity on the wall surface side, but, in a region having a large diameter, a turbulent flow caused in a groove shape or a hollow shape serves as a resistance. In particular, it is considered that greater effects are obtained when a hollow shape or a groove shape is present within a region having a diameter twice that of the thinnest portion.

Further, the amount of liquid droplets ejected from any nozzle was 1.5 pL or less.

TABLE 4

| | 13 V | 14 V | 15 V | 16 V |
|---|---|---|---|---|
| (a) | No ejection | 1.5 m/s | 2 m/s | Separation of liquid droplets |
| (b) | 3 m/s | 5 m/s | 7 m/s | 8.5 m/s |
| (c) | 3 m/s | 5 m/s | 7 m/s | 8.5 m/s |
| (d) | 1.5 m/s | 3 m/s | 4 m/s | 5 m/s |

Example 5

In order to check the size influence of a groove shape on a nozzle plate inner wall, one ring-shaped groove shape was formed while varying the size thereof in a region having the smallest diameter on a nozzle exiting side, and the ejection performance was checked after producing a head.

An ejection unit was produced in the same way as in Examples 1 to 4.

A nozzle was set to have a nozzle plate thickness of 80 μm, a nozzle exiting side diameter of φ10 μm, an exiting side straight region length of 15 μm, and an entering side diameter of φ40 μm, and only one ring-shaped groove with a width of 0.8 μm to 8 μm and a depth of 0.4 μm to 8 μm was formed in a straight region of 15 μm. For comparison, a nozzle having no ring-shaped micron-size groove was produced simultaneously. First, each mold corresponding to a nozzle hole having the above-mentioned ring-shaped groove was processed to Cu by changing cutting conditions of an endmill.

Next, in the same way as in Examples 1 to 4, each mold was subjected to Ni—P plating, followed by grinding and polishing to adjust the plate thickness to 80 μm, and the Cu mold was removed by etching. After etching, the etchant was completely removed with a pure water and ultrasonic wave, followed by drying, and further a water-repellent film was vapor-deposited on an exiting surface side to complete a nozzle plate. Finally, the nozzle plate and the ejection unit were bonded to each other, and a flexible cable for feeding power, a manifold for supplying ink, and the like were mounted on the resultant to complete an ink jet head.

The ink jet head thus produced was evaluated for an ink ejection state through use of a mixed solution containing 92% ethylene glycol and 8% water as ink.

The driving condition for ejection was the application of a rectangular wave of 15 V to 17 V with a pulse width of 8 μs. The ejection frequency was set to 5,000 Hz. In the same way as in Example 1, the evaluation was conducted by microscope observation through use of a nanopulse light source, and the flying state and liquid droplet velocity of liquid droplets were evaluated.

The results are shown in Table 5.

In the reference nozzle having no groove shape and the nozzles having a small groove width and depth, the liquid droplet separation threshold was 2 m/s, whereas in the nozzles having a groove shape with a groove width of 1 μm or more and a depth of 0.5 μm or more, the liquid droplet separation threshold was able to be increased to at least 5 m/s. Further, by increasing the groove width and groove depth, the velocity threshold of liquid droplet separation was able to be further increased with the liquid droplet amount being 1.5 pL or less. Note that, when the groove width reaches 8 μm, the liquid droplet amount exceeds 2 pL.

Accordingly, it can be said that the range of 1 μm to 6 μm of the groove shape width and the range of 0.5 μm to 6 μm of the groove depth have a great effect on the object of the present invention.

TABLE 5

| Groove width | Groove depth | 15 V | 16 V | 17 V |
|---|---|---|---|---|
| — | — | 2 m/s | Separation of liquid droplets | Separation of liquid droplets |
| 0.5 μm | 0.3 μm | 2 m/s | Separation of liquid droplets | Separation of liquid droplets |
| 1 μm | 0.3 μm | 2 m/s | Separation of liquid droplets | Separation of liquid droplets |
| 1 μm | 0.5 μm | 3 m/s | 4 m/s | 5 m/s |
| 3.6 μm | 1.8 μm | 4 m/s | 4.5 m/s | 5.5 m/s |
| 6 μm | 3 μm | 4.5 m/s | 5.5 m/s | 6.5 m/s |
| 6 μm | 6 μm | 4.5 m/s | 5.5 m/s | 6.5 m/s |
| 8 μm | 4 μm | 4.5 m/s | 5.5 m/s | 6.5 m/s |
| | | 2 pL or more | 2 pL or more | 2 pL or more |
| 8 μm | 8 μm | 4.5 m/s | 5.5 m/s | 6.5 m/s |
| | | 2 pL or more | 2 pL or more | 2 pL or more |

Example 6

The following ejection unit was produced for the purpose of checking the appropriate density of a hollow shape.

A nozzle was produced by varying a recess diameter of an inner wall based on a shape of a nozzle plate having a smooth taper as illustrated in the schematic sectional view of FIG. 5A and having a plate thickness of 80 μm, a nozzle exiting side diameter of φ10 μm, and an entering side diameter of φ50 μm (FIG. 5B). For formation of the recess, wet etching is used in the same way as in Examples 1 and 2, which results in isotropic etching, and the depth of the recess is about ½ of a recess long diameter.

For production of a nozzle plate, a shape serving as a mold of a hole was first produced with an endmill. Next, the mold was subjected to Ni—P plating, followed by grinding and polishing to adjust Ni—P plating to 80 μm. Finally, Cu of the mold was removed with an alkaline etchant to obtain a nozzle plate. A nozzle plate having no hollow shape as a reference was completed by completely washing a Cu residue with pure water and ultrasonic wave after Cu etching. Regarding a nozzle plate having a hollow shape, after etching of the Cu mold, the etchant was not replaced by pure water by washing with pure water and ultrasonic wave, and the nozzle plate was dried while the etchant in the nozzle remained in a state of being soaked in pure water and soaked in diluted sulfuric acid while the Cu residue in the etchant was allowed to adhere onto the nozzle inner wall. In this case, the density of a recess portion was controlled by changing an etchant remaining amount by changing time for soaking in pure water. Further, the soaking time in diluted sulfuric acid was adjusted so that the recess size had a maximum area of 3 μm.

Finally, a water-repellent film was formed from an exiting side of the nozzle plate, and the nozzle plate and the ejection unit were bonded to each other. Further, a flexible cable for feeding power, a manifold for supplying ink, and the like were mounted on the resultant to complete an ink jet head.

The ink jet head thus produced was evaluated for an ink ejection state through use of a mixed solution containing 92% ethylene glycol and 8% water as ink. The method of evaluating the ejection state was the same as those of Examples 1 to 3, and the driving condition for ejection was the application of a rectangular wave of 15 V having a pulse width of 8 μs. The ejection frequency was set to 5,000 Hz.

Table 6 shows the recess density and the ejection velocity of each nozzle. Note that, the recess density is evaluated from an SEM image of a nozzle cross-section after the evaluation of the ejection velocity.

It was found that there was an effect when the recess density reached 10% or more with respect to a nozzle having no hollow shape. When the recess density increases to 80%, the ejection velocity slightly decreases. The reason for this is considered as follows: the hollow shape in a region having a large nozzle diameter serves as a resistance to a fluid. It is understood that sufficient effects are obtained compared to a nozzle having no hollow shape.

TABLE 6

| Ratio of hollow shape with respect to surface area in nozzle | 0% | 10% | 50% | 80% |
|---|---|---|---|---|
| Ejection velocity | 2 m/s | 4 m/s | 4.1 m/s | 3.9 m/s |

Example 7

The following ejection unit was produced for the purpose of checking the appropriate density of a groove shape.

A nozzle was set to have a nozzle plate thickness of 80 μm, a nozzle exiting side diameter of φ10 μm, an exiting side straight region length of 15 μm, and an entering side diameter of φ40 μm. One to 15 ring-shaped grooves with a width of 1 μm and a depth of 0.5 μm were formed in a straight region of 15 μm of the nozzle. For comparison, a nozzle having no ring-shaped groove was also produced simultaneously.

First, each mold corresponding to a nozzle hole having the above-mentioned ring-shaped groove shape was fabricated to Cu by changing the cutting condition of an endmill.

For production of a nozzle plate, a shape serving as a mold of a hole was first produced with an endmill. Next, the mold was subjected to Ni—P plating, followed by grinding and polishing to adjust the Ni—P plating to 80 μm. Finally, Cu of the mold was removed with an alkaline etchant to obtain a nozzle plate. Finally, a water-repellent film was formed from an exiting side of the nozzle plate, and the nozzle plate and the ejection unit were bonded to each other. Further, a flexible cable for feeding power, a manifold for supplying ink, and the like were mounted on the resultant to complete an ink jet head.

The ink jet head thus produced was evaluated for an ink ejection state through use of a mixed solution containing 92% ethylene glycol and 8% water as ink. The method of evaluating the ejection state was the same as those of Examples 1 to 5, and the driving condition for ejection was the application of a rectangular wave of 15 V having a pulse width of 8 μs. The ejection frequency was set to 5,000 Hz.

Table 7 shows the number of groove shapes and the ejection velocity of each nozzle. It is found from Table 7 that there was an effect when the groove density of a straight portion reached 6% or more with respect to a nozzle having no groove shape.

TABLE 7

| Number of grooves | None | One | Five | Ten | Fifteen |
|---|---|---|---|---|---|
| Ratio of groove portion with respect to surface area of straight portion | 0% | 6% | 30% | 60% | 100% |
| Ejection velocity | 2 m/s | 3.0 m/s | 3.2 m/s | 3.4 m/s | 3.4 m/s |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-143540, filed Jul. 9, 2013, which is hereby incorporated by reference herein in their entirety.

REFERENCE SIGNS LIST

1 pressure chamber
2 dummy chamber
3 partition wall
7 electrode dividing groove
10 ejection unit
11 ceiling
12 substrate main body
13 piezoelectric element
30 nozzle plate
**30*a*** nozzle hole
40 manifold
41 ink supply port
42 ink discharge port
43 common flow path
50 flexible substrate
51 signal wire
100 ink jet head (liquid ejection head)

The invention claimed is:

1. A liquid ejection head comprising a nozzle for ejecting a liquid, wherein a recess portion recessed relative to a nozzle inner wall surface of the nozzle is formed on a nozzle inner wall in a region having an inner diameter of the nozzle of 15 μm or less, wherein the recess portion has one of a hollow shape and a groove shape, wherein the hollow shape has a maximum area of an opening of a hollow portion of 0.8 $\mu m^2$ to 20 $\mu m^2$, and wherein the groove shape has a groove width of 1 μm to 6 μm and a depth of 0.5 μm to 6 μm.

2. The liquid ejection head according to claim 1, wherein the recess portion is formed on the nozzle inner wall in a region extending from a portion having a minimum inner diameter of the nozzle to a portion having an inner diameter twice the minimum inner diameter of the nozzle.

* * * * *